US007035561B2

(12) United States Patent
Onishi

(10) Patent No.: US 7,035,561 B2
(45) Date of Patent: Apr. 25, 2006

(54) IMAGE DEVELOPING APPARATUS AND IMAGE FORMING APPARATUS UTILIZING THE SAME

(75) Inventor: Akihito Onishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/603,660

(22) Filed: Jun. 26, 2003

(65) Prior Publication Data

US 2004/0001725 A1 Jan. 1, 2004

(30) Foreign Application Priority Data

Jun. 28, 2002 (JP) ..... 2002-190002

(51) Int. Cl.
*G03G 15/08* (2006.01)

(52) U.S. Cl. ..... 399/55

(58) Field of Classification Search ..... 399/55, 399/222, 272, 281, 53, 285

See application file for complete search history.

(56) References Cited

U.S. PATENT DOCUMENTS 4,912,513 A * 3/1990 Oka et al. ..... 399/138
6,134,397 A * 10/2000 Shimazaki et al. ..... 399/55

FOREIGN PATENT DOCUMENTS

JP 2-301789 * 12/1993
JP 411125938 A * 5/1999

* cited by examiner

*Primary Examiner*—Quana Grainger
(74) *Attorney, Agent, or Firm*—Rabin & Berdo, P.C.

(57) ABSTRACT

An image to be formed on paper (26) is held on the surface of photo-sensitive drum (1). This is a latent image of static electricity formed by an LED exposer (5). Then, the developing roller (7) puts toner on the surface of photo sensitive drum (1), so as to develop a toner image. Meanwhile, the toner conveying roller (9) supplies toner to the developing roller (7). In this occasion, the printer controller (17) calculates the image density of image data (18) with dot counter (13). And, it decides the first voltage impressed to developing roller (7) by developing bias source (8) as well as the second voltage impressed to toner conveying roller (9) by stretching bias source (10) according to the image density of original image.

20 Claims, 12 Drawing Sheets

15

| (NO) IMAGE DENSITY (%) | DRUM COUNT ($D_P$) | | | | |
|---|---|---|---|---|---|
| | 0~1k | 1~5k | 5~10k | 10~15k | 15k~ |
| 0~2.5 | 50 | 50 | 50 | 50 | 25 |
| 2.5~5 | 100 | 100 | 100 | 50 | 50 |
| 5~25 | 150 | 150 | 100 | 100 | 100 |
| 25~50 | 150 | 150 | 150 | 150 | 150 |
| 50~75 | 200 | 200 | 200 | 200 | 200 |
| 75~100 | 200 | 200 | 200 | 250 | 250 |

DATA ROM

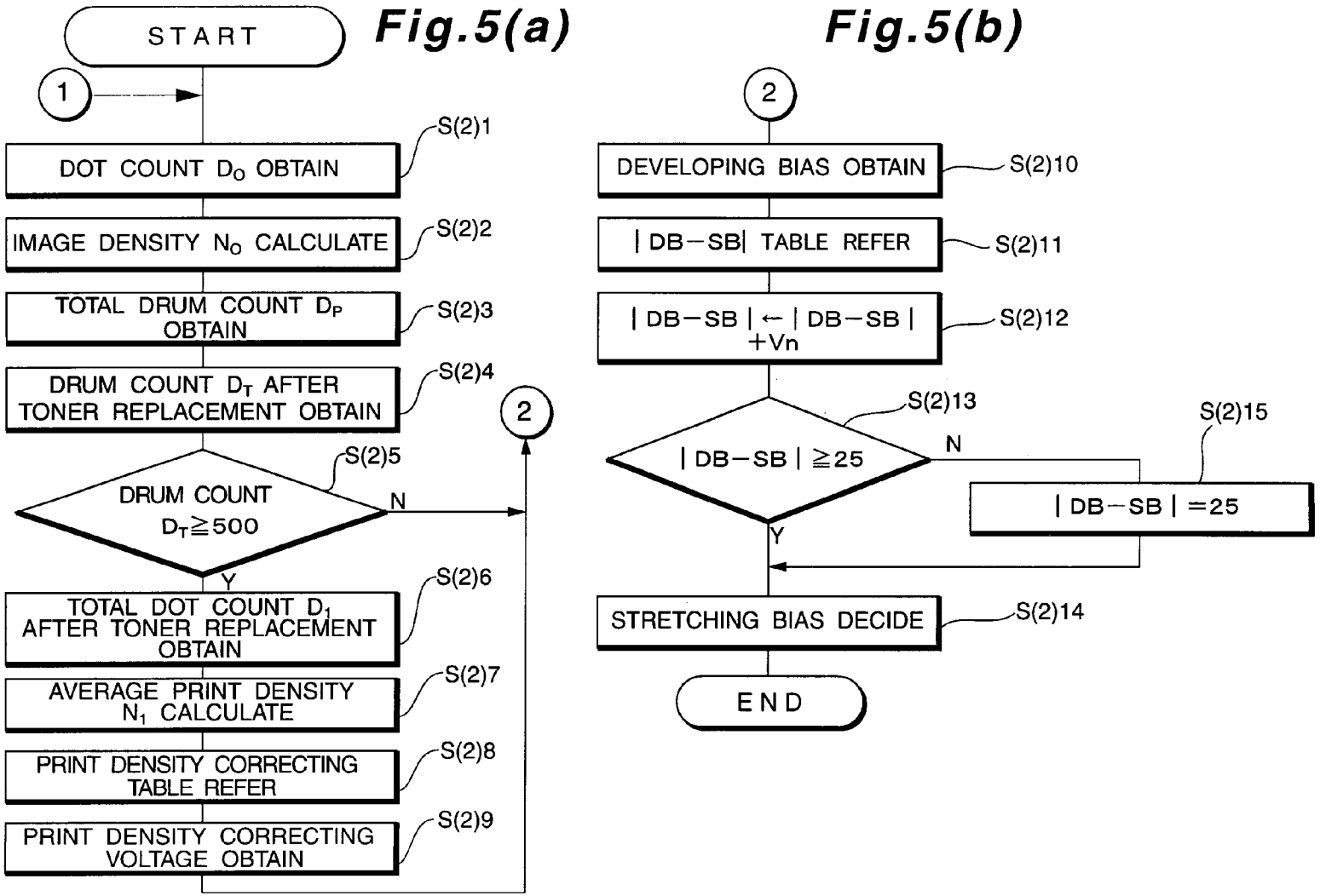
Fig.5(a)
START
1
S(2)1
DOT COUNT $D_O$ OBTAIN
S(2)2
IMAGE DENSITY $N_O$ CALCULATE
S(2)3
TOTAL DRUM COUNT $D_P$ OBTAIN
S(2)4
DRUM COUNT $D_T$ AFTER TONER REPLACEMENT OBTAIN
S(2)5
DRUM COUNT $D_T \geqq 500$
N
Y
2
S(2)6
TOTAL DOT COUNT $D_1$ AFTER TONER REPLACEMENT OBTAIN
S(2)7
AVERAGE PRINT DENSITY $N_1$ CALCULATE
S(2)8
PRINT DENSITY CORRECTING TABLE REFER
S(2)9
PRINT DENSITY CORRECTING VOLTAGE OBTAIN
Fig.5(b)
2
S(2)10
DEVELOPING BIAS OBTAIN
S(2)11
| DB−SB| TABLE REFER
S(2)12
| DB−SB | ← | DB−SB | +Vn
S(2)13
| DB−SB | ≧25
N
Y
S(2)15
| DB−SB | =25
S(2)14
STRETCHING BIAS DECIDE
END

Fig.6

| (NO) IMAGE DENSITY (%) | AVERAGE PRINT DENSITY $N_1$(%) | | | | |
|---|---|---|---|---|---|
| | 0~2.5 | 2.5~5 | 5~25 | 25~50 | 50~100 |
| 0~2.5 | -40 | -20 | -10 | -5 | 0 |
| 2.5~5 | -20 | -10 | -5 | 0 | 0 |
| 5~25 | -10 | -5 | 0 | 0 | 0 |
| 25~50 | +10 | 0 | 0 | 0 | 0 |
| 50~75 | +20 | +10 | +5 | 0 | 0 |
| 75~100 | +40 | +20 | +10 | +5 | 0 |

DATA ROM

15

| (TO) TENP.(°C) | HUMID. (%) ($S_0$) | | | | | |
|---|---|---|---|---|---|---|
| | 5 | 10 | 20 | 40 | 60 | 80 |
| 5 | -50 | -45 | -40 | -35 | -30 | -25 |
| 10 | -40 | -35 | -30 | -25 | -20 | -15 |
| 15 | -20 | -15 | -10 | -5 | 0 | +5 |
| 20 | -5 | 0 | +5 | +10 | +15 | +20 |
| 25 | 2 | +5 | +10 | +15 | +20 | +25 |
| 30 | +10 | +15 | +20 | +25 | +30 | +35 |
| 35 | +20 | +25 | +30 | +35 | +40 | +45 |

CONTROLLER ROM

14

| (T2) AVERAGE PRINT TENP. °C | DRUM COUNT ($D_T$) | | | | |
|---|---|---|---|---|---|
| | 0~1k | 1~5k | 5~10k | 10~15k | 15k~ |
| 30 | 0 | 0 | 0 | 0 | 0 |
| 40 | 0 | 0 | +5 | +10 | +20 |
| 45 | 10 | +5 | +10 | +20 | +30 |
| 50 | +5 | +10 | +20 | +30 | +40 |
| 55 | +10 | +20 | +30 | +40 | +50 |

CONTROLLER ROM

14

IMAGE DEVELOPING APPARATUS AND IMAGE FORMING APPARATUS UTILIZING THE SAME

BACKGROUND OF THE INVENTION

1. Field of the Invention

The present invention relates to an image forming apparatus by electro-photography, such as an electro-photographic printer, copy machine or facsimile etc.

2. Description of the Related Art

In general, an image forming apparatus such as printer, copy machine or facsimile, is expected to provide a clear and fair printing as a matter of course.

And, hereafter, an image forming apparatus by electro-photography, is analyzed in view of providing such printing. Although, FIG. 2 shows the structure of present invention, this is useful for describing general structure and function of electro-photographic apparatus.

In this kind of apparatus, as shown in FIG. 2, a photo-sensitive drum 1 is charged negative by a charging roller 22 at first. And, next, beams of light are radiated on the surface of the photo-sensitive drum 1 by an LED exposer 5. Then, a certain latent image of static electricity is formed thereon. And, here, a toner image is formed on this latent image with toner, which is given from the surface of developing roller 7 to the surface of photo-sensitive drum 1.

In this occasion, the thickness of toner layer on the surface of developing roller 7, must be a certain adequate height, in order to form fair toner image on the surface of photo-sensitive drum 1. Here, the toner on the surface of developing roller 7, is supplied by the toner conveying roller 9 with a control of developing blade 21. And, a certain adequate voltage is impressed between the developing roller 7 and the toner conveying roller 9 with developing blade 21.

The toner image formed on the surface of photo-sensitive drum 1, is transferred onto the surface of paper 26 by a transfer device, comprising a transfer belt 25, a transfer roller 27 etc. And, the toner remained on the surface of photo-sensitive drum 1, is cleaned away by a cleaning device 23.

Moreover, as for color electro-photographic printer, as many as four image forming apparatuses, each of which comprises the same as mentioned above, are provided for four fundamental color of Y,M,C,K. And, in this kind of color printer, the each amount of toner transferred onto paper must be controlled more precisely than the monochrome printer mentioned above, in order to reproduce a fair color image, because four independent image of Y,M,C,K, are laid over with each other on the same surface of paper. Therefore, in this kind of color printer, adopted is a method of process control as follows.

That is, a certain patch pattern image is printed on the transfer belt 25 in advance. And, its color density is measured by the density sensor 16. Then, a condition of process control is decided according to the density data.

In this method, the amount of toner transferred onto paper is detected by the density sensor as well. And, the amount of toner sticking to paper is pre-estimated. Then, the voltage impressed between developing roller 7 and toner conveying roller 9 etc. is controlled according to this pre-estimated amount of toner. And, in this method, the voltage is decided in the consideration that a certain adequate amount of toner is conveyed from the conveying roller to the developing roller.

However, there are other points to consider, in order to obtain a clear and fair printing.

One of these points is the quality of toner, such as flowing ability, charging ability etc. These can remarkably change when printing operation repeated and the apparatus became old. For example, the flowing ability of toner decreases when the toner deteriorated with heat. This kind of heat is emitted with friction of the developing roller etc. Or, this kind of heat is conducted from a fixer of toner. On the other hand, the charging ability of toner can increase when the toner became old. This kind of situation can be caused especially in the occasion when low printing duty images are printed repeatedly, because the consumption of toner is less than usual and toner is remained in the tank to deteriorate. As a result, the amount of toner, which sticks to the latent image of static electricity, differs even if the same amount of toner is supplied to the surface of developing roller 7.

Another point is the quality of apparatus. For example, conveying ability of toner conveying roller can decrease with wearing away of the surface of the roller.

Therefore, it is necessary to consider changes of image forming apparatus itself after it formed many images. And, it is also necessary to consider temperature or humidity around the apparatus in order to watch the quality of toner.

SUMMARY OF THE INVENTION

The present invention aimed at providing an image forming apparatus, which is able to solve problems in the conventional art in order to obtain a more preferable image.

Therefore, the present invention adopts next configuration.

First is an image forming apparatus comprising a developing means of putting developing material to sticking to an image holder, so as to form an image corresponding to an image data; a developing material supplying means of supplying said developing material to said developing means; a first electricity source for impressing said developing means with a first voltage; a second electricity source for impressing said developing material supplying means with a second voltage; an image density detecting means of detecting image density from said image data; and a controller for controlling each supply of said first electricity source and said second electricity source according to said image density detected by said image density detecting means.

Second is an image forming apparatus according to the first one, wherein said controller controls the electric potential difference between said first voltage and said second voltage according to said image density detected by said image density detecting means.

Third is an image forming apparatus according to the first one, further comprising a limiting means for toner, which limits a thickness of toner layer formed on the surface of developing means; wherein said first electricity source impresses said limiting means for toner, with said first voltage.

Fourth is an image forming apparatus according to the first one, further comprising an operation amount detecting means of detecting amount of operation; wherein said controller controls each supply of said first electricity source and said second electricity source according to said amount of operation and said image density.

Fifth is an image forming apparatus according to the first one, wherein said controller calculates the average image density between the last time of toner tank replacement and the present time, from the records of image density detected by said image density detecting means; so as to control each supply of said electricity sources according to said average image density.

Sixth is an image forming apparatus according to the first one, further comprising an environmental condition detecting means of detecting the environmental condition around the apparatus in operation; wherein said controller corrects each supply of said electricity sources according to said environmental condition.

Seventh is an image forming apparatus according to the first one, further comprising a surface temperature detecting means of detecting surface temperature of said image holder of said developing means; wherein said controller calculates the average printing temperature from the records of surface temperature detected by said surface temperature detecting means; so as to correct each supply of said electricity sources according to said average printing temperature.

Eight is an image forming apparatus according to the fourth one, wherein said operation amount detecting means detects said amount of operation according to the revolution number of said image holder of said developing means.

Ninth is an image forming apparatus according to the seventh one, further comprising a presenting means of presenting a prescribed message; wherein said controller informs the user of apparatus of said prescribed message by presenting at said presenting means, when said average printing temperature exceeded a prescribed temperature.

BRIEF DESCRIPTION OF THE DRAWINGS

FIG. 5 is a flow-chart showing the control process of Embodiment 2.

FIG. 6 shows the correcting voltage table of average printing density of Embodiment 2.

DETAILED DESCRIPTION OF THE PREFERRED EMBODIMENTS

Figure 1:
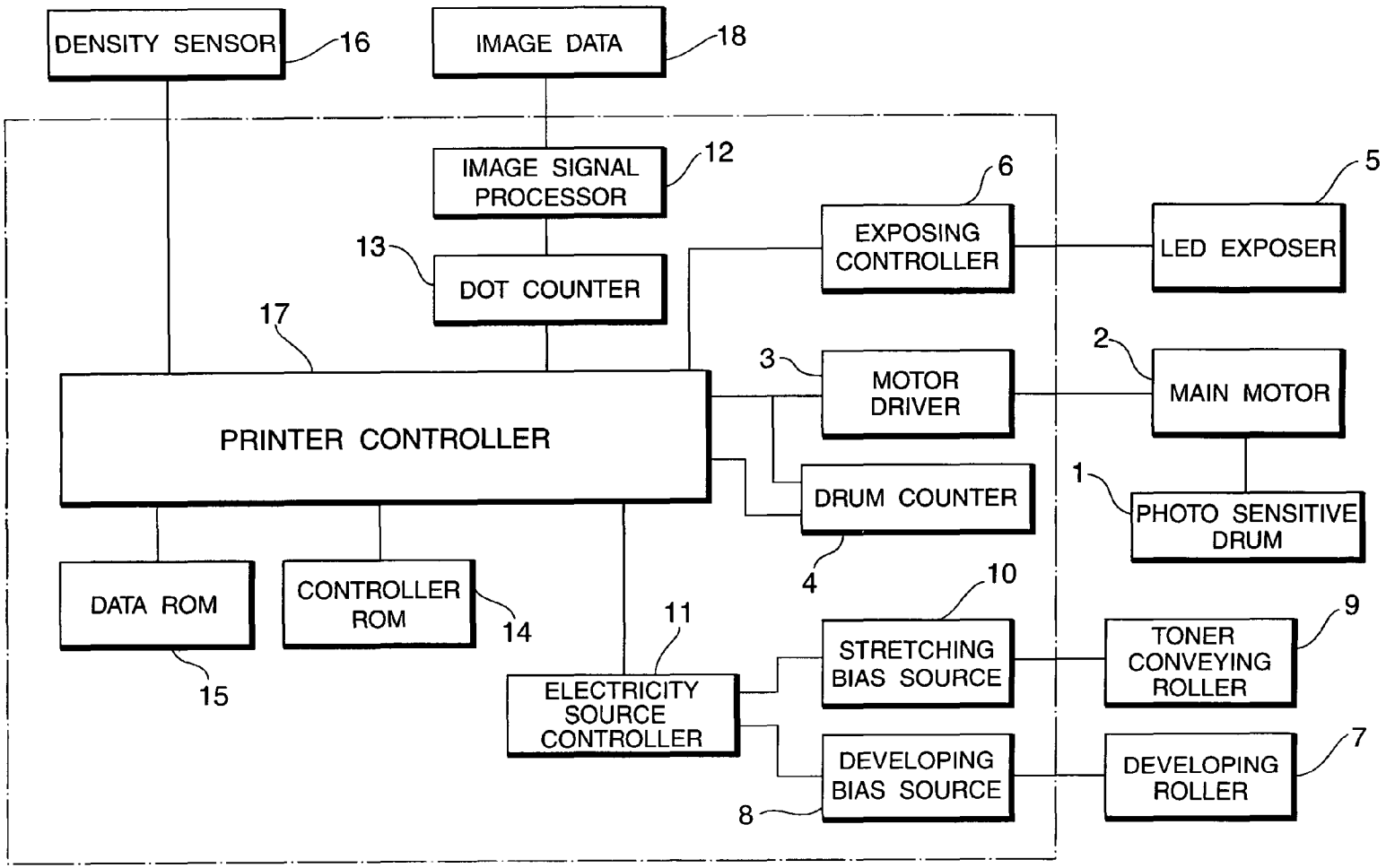
FIG. 1 is a block diagram showing the configuration of Embodiment 1.

Hereafter, the preferred Embodiments according to present invention will be described referring to the drawings.

Embodiment 1

In Embodiment 1, |DB−SB| voltage table is provided in an image forming apparatus. This table is made in consideration of aging of the apparatus. And, this table is used for correcting flowing rate of toner (developing material) conveyed by conveying roller, so as to compensate the changing of toner flowing rate caused by aging of the apparatus. Here, DB is each electric potential of the surface of developing roller. And, SB is each electric potential of the surface of toner conveying roller.

FIG. 1 is a block diagram showing the configuration of Embodiment 1.

As shown in FIG. 1, the image forming apparatus of Embodiment 1 comprises a photo-sensitive drum 1, a main motor 2, a motor driver 3, a drum counter 4, an LED exposer 5, an exposing controller 6, a developing roller 7, a developing bias source 8, a toner conveying roller 9, a stretching bias source 10, an electricity source controller 11, an image signal processor 12, a dot counter 13, a controller ROM 14, a data ROM 15, a density sensor 16, and a printer controller 17.

Figure 2:
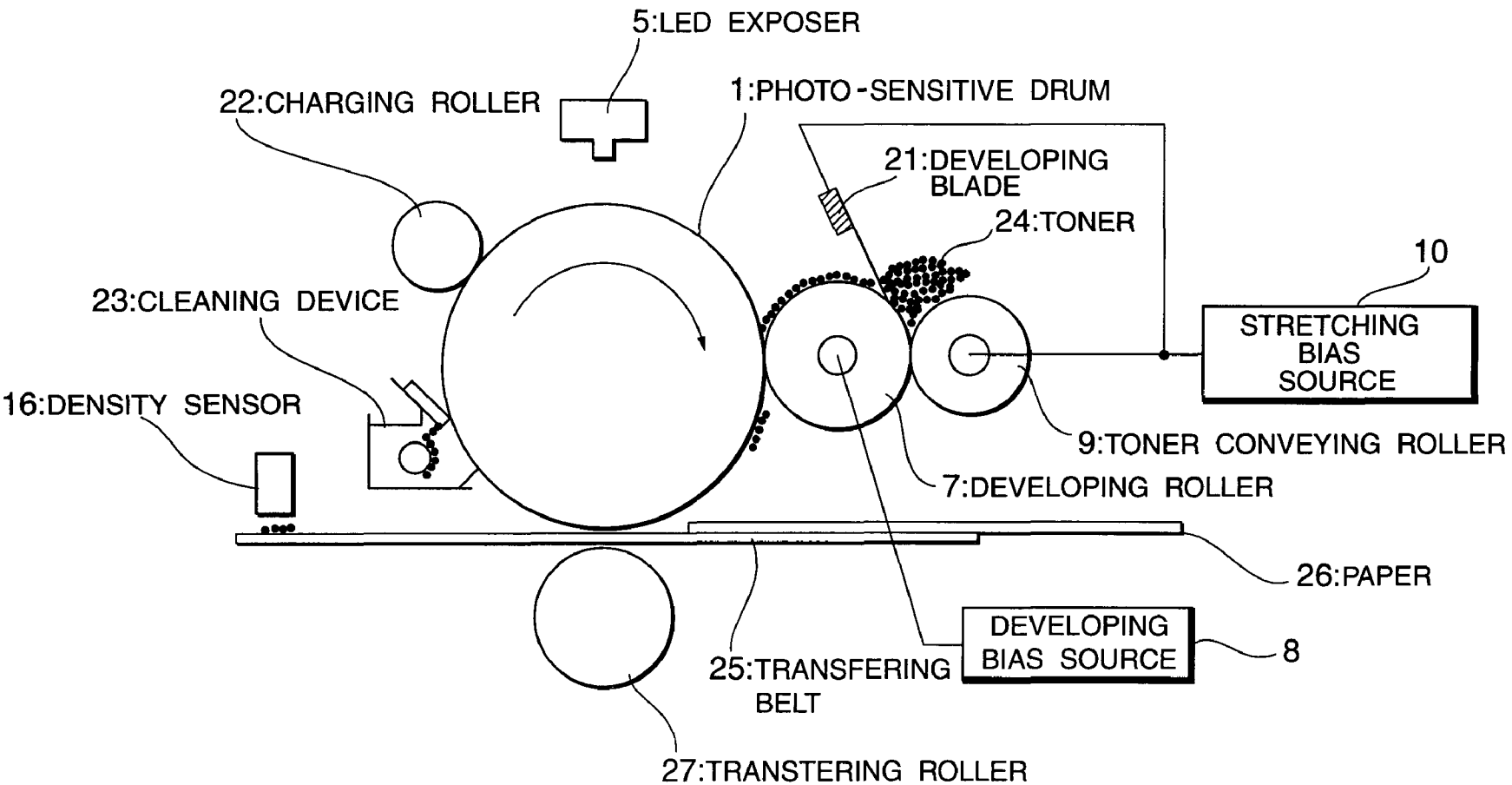
FIG. 2 is a sectional view of the configuration of Embodiment 1.

FIG. 2 is a sectional plan of the configuration of Embodiment 1.

This is a sectional plan to show the function performed with the main portions of the mechanism of image forming apparatus according to Embodiment 1.

Hereafter, mainly referring to this FIG. 2 occasionally together with FIG. 1, the main portions of the configuration of Embodiment 1 is described with including its function. In FIG. 2 and FIG. 1, the common component parts are designated with the same symbols respectively.

In these component parts; the photo-sensitive drum 1, the developing roller 7 etc. comprise a developing means. The toner conveying roller 9 etc. comprises a developing material supplying means. The developing bias source 8 comprises a first electricity source. The stretching bias source 10 comprises a second electricity source. The dot counter 13 comprises an image density detecting means. And, the printer controller 17 comprises a controller, which is mentioned in the claims.

Moreover, the dot counter 13, the data ROM 15, with the printer controller 17 comprise an operation amount detecting means of obtaining total drum count as amount of operation (c.f. Step S(1)1 in Operation of Embodiment 1).

The photo-sensitive drum 1 functions as a holder of an image while it rotates to the direction indicated by the arrow shown in the drawing, and it plays a central role in the image forming apparatus. Hereafter, the printing process is described in the order of the direction of the arrow. The surface of photo-sensitive drum 1 is usually covered with an insulator comprising a heat-resisting material such as a rubber material. The photo-sensitive drum 1 (c.f. FIG. 1) is rotated by the main motor 2 (FIG. 1), which is driven by the motor driver 3 (FIG. 1) under the control of the printer controller 17 (FIG. 1). The rotation speed of the photo-sensitive drum 1 is measured by the drum counter 4 (FIG. 1). And, the measured data is memorized in the data ROM 15 (FIG. 1).

The charging roller 22 is a section for charging the surface of photo-sensitive drum 1 at about minus 800V for example. This is impressed with a negative high voltage not shown in the drawings.

The LED exposer 5 radiates a ray of light at the surface of photo-sensitive drum 1, which is charged at about minus 800V, so as to form an electro-static latent image of the image data 18 (FIG. 1). This usually comprises lightemitting device such as LED array etc. This device is controlled by the exposing controller 6 (FIG. 1). These LED exposer 5 (FIG. 2) and exposing controller 6 (FIG. 1) co-operate to form an exposing means.

The image signal processor 12 (FIG. 1) is a section for transforming the image data 18 (FIG. 1) to dot data. Rays of light corresponding to the dot data radiate from the LED exposer 5 (FIG. 1) at the surface of photo-sensitive drum 1. The surface electric potential of the radiated portion increases to about 0V. In this way, the portion with electric potential changed that is electro-static latent image is formed on the surface of photo-sensitive drum 1.

The dot counter 13 (FIG. 1) is a section for counting the number of dots on the original image data of a sheet of A4 size paper, when the image signal processor 12 (FIG. 1) transformed the image data to dot data. This counted dot number is memorized in the data ROM 15 (FIG. 1).

The developing roller 7 as a developing means is a section for developing the electro-static latent image with toner, which sticks to the image portion of the surface of photo-sensitive drum 1 mentioned above. The surface electric potential DB of this developing roller 7 is kept at about minus 300V for example by the developing bias source 8 (developing electricity source).

The toner conveying roller as a toner feeding means is a section for feeding toner to the developing roller 7. The surface electric potential SB of this toner conveying roller 9 is kept at about minus 400V for example by the stretching bias source 10 (toner feeding electricity source).

The electricity source controller 11 (FIG. 1) is a section for setting and altering respectively the surface electric potential DB of developing roller 7 and the surface electric potential SB of toner conveying roller 9 mentioned above, according to the control of printer controller 17 (FIG. 1). In Embodiment 1, a preferable image is reproduced by controlling the absolute value |DB−SB| of the difference of electricity potential between the surface electric potential DB of developing roller 7 and the surface electric potential SB of toner conveying roller 9. Hereafter, the principle of image reproduction is described.

In conventional technique, the surface electric potential SB of toner conveying roller 9 is decided with only considering whether a certain adequate amount of toner is conveyed from toner conveying roller 9 to developing roller 7. But, even if a certain amount of toner 24 is conveyed to developing roller 7 from toner conveying roller 9, the amount of toner which sticks to the electro-static latent image differs according as the image forming apparatus itself ages or the circumstances such as temperature, humidity etc. change at operation. The reason why the amount of toner to stick, differs; is that: ability to charge of toner or ability to flow of toner, may extremely change.

That is, the ability to flow of toner may decrease by deterioration of toner 24. The cause of it may be heat, which is emitted by friction of the developing roller etc. or which is conducted from the fixer etc. And, whether this kind of heat is caused or not depends on the state of printer or its circumstances when operation of printer is continued. Moreover, the ability to charge of toner may increase by another kind of deterioration of toner 24. This may be caused by low consumption of toner 24 when an image of low printing duty is printed, because only a little toner is used and old toner is remained in the toner tank. Therefore, in Embodiment 1, the absolute value |DB−SB| is adjusted according to aging of image forming apparatus or change of circumstances such as temperature or humidity etc. By adopting this kind of control, a preferable image is reproduced. As for the method of control, it is described in detail in the description of the operation of Embodiment 1.

The developing blade 21 as a limiting means for toner, is a section for limiting an amount of toner, that is, a thickness of toner layer formed on the surface of developing roller 7. In this invention, also to this developing blade 21, a surface electric potential SB of toner conveying roller 9 is impressed by the stretching bias source 10 mentioned above. In this way, an amount of toner layer formed on the surface of developing roller 7 is limited by adjusting the charging amount of toner 24, not only by mechanical control of toner 24 provided to the surface of developing roller 7 with using the blade.

The transfer roller 27 is a section for transferring an image of toner formed on the photo-sensitive drum 1, to a paper 26. This roller is impressed with a positive high voltage; in order to transfer toner charged negative on the photo-sensitive drum 1, to a paper 26.

The transfer belt 25 is a section for conveying a paper 26, while it is driven by conveying rollers not shown in the drawings. Further, this is also a section used for correcting density of toner automatically, by transferring a patch-pattern and measuring its density of color. Toner density correction is a kind of a process control, which adjusts the surface electric potential DB of developing roller 7 in order to obtain a prescribed toner density. This control is performed when the electricity source of image forming apparatus is turned on, or when the apparatus starts again after a certain time of a halt. Then, a patch-pattern etc. is transferred to the transfer belt 25, so as to measure its toner density by the density sensor 16. And, the surface electric potential DB of developing roller 7 is adjusted according to the measured data. Here, an automatic density correcting table (not shown in the drawings) to decide the surface electric potential DB of developing roller 7 according to the toner density measured by density sensor 16, is contained in the data ROM 15 beforehand.

The cleaning device 23 is a section for removing toner remained on the surface of photo-sensitive drum 1.

The controller ROM 14 (FIG. 1) is a section for containing programs or tables etc. which is necessary for controlling the image forming apparatus of Embodiment 1. Herein contained as well, are |DB−SB| voltage table, which will be described later, or the automatic density correcting table mentioned above etc.

The printer controller 17 is a CPU, which performs an over-all control of the component sections of image forming apparatus according to Embodiment 1.

Incidentally, the image signal processor 12 (FIG. 1), dot counter 13 (FIG. 1), and electric source controller 11 (FIG. 1) are usually included in a control program as a function of the printer controller 17; though they may be made up individually as original component sections. If they are included in a control program, this control program is contained in the controller ROM 14 beforehand.

Operation of Embodiment 1

Figures 3, 4:
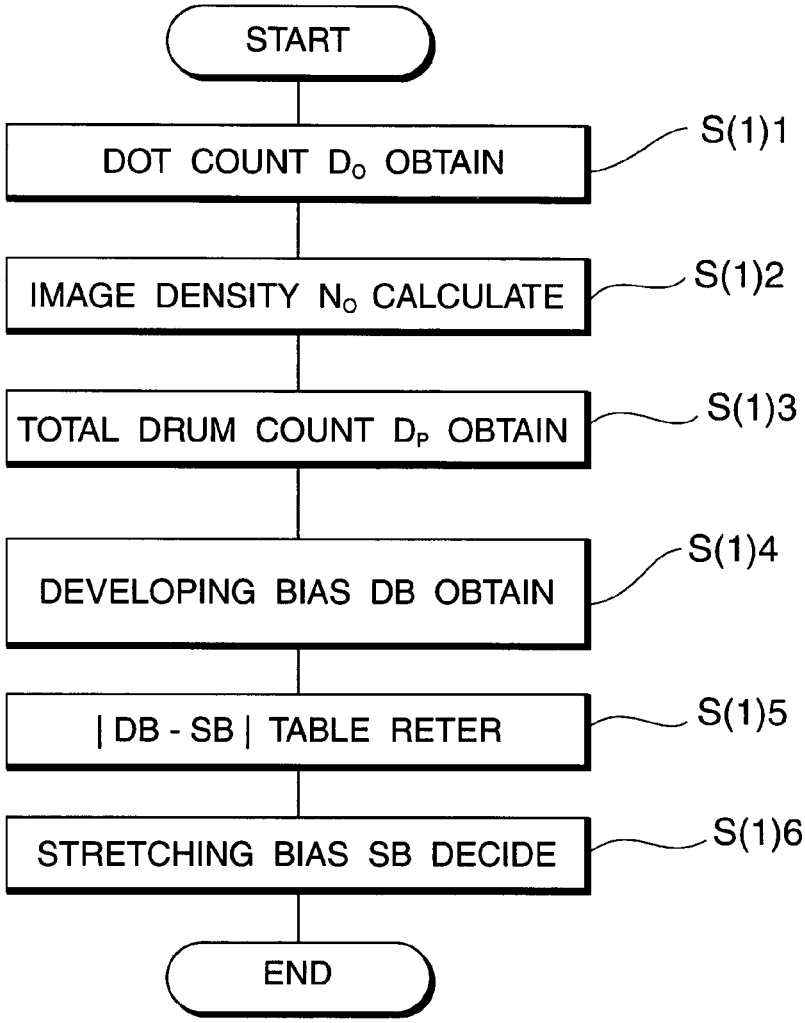
FIG. 3 is a flow-chart showing the control process of Embodiment 1.
FIG. 4 shows |DB−SB| voltage table of Embodiment 1.

FIG. 3 is a flowchart showing each step in the control according to Embodiment 1.

The operation of Embodiment 1 is described referring to steps S(1)1 to S(1)6 of FIG. 3.

Step S(1)1

The image signal processor 12 (FIG. 1) accepts one page of image data 18 (FIG. 1) in the size of A4 standard, and it transforms this data into dot data. In this occasion, the dot counter 13 (FIG. 1) measures total dot number of one page of original image in A4 standard. And, it obtains the count value Do. This Do is recorded in the data ROM15 (FIG. 1).

Step S(1)2

The printer controller 17 (FIG. 1) reads out count value Df representing a standardized dot number in the occasion of printing 100% Duty image at A4 size paper. This value Df is contained in the data ROM 15 (FIG. 1) in advance. So, the printer controller 17 reads out Df from it. And, the printer controller 17 also reads out from the data ROM 15, the value Do mentioned above. Then, it calculates a density NO of the original image according to following formula.

$$No=(Do/Df)\times 100(\%) \quad \text{(f1)}$$

Step S(1)3

The printer controller 17 (FIG. 1) reads out from the data ROM 15 (FIG. 1), a total drum count value Dp, which represents an accumulated count number of dot on photo-sensitive drum 1 (FIG. 1) about all the pages ever printed. And, the count number about the present page, which is now going to print, is calculated from the revolution number of photo-sensitive drum 1 (FIG. 1) of this time. So, the entirely total drum count including this time of operation, is detected at this step.

Step S(1)4

The printer controller 17 (FIG. 1) reads out the developing bias voltage DB from the above mentioned automatic density correcting table of data ROM 15 (FIG. 1) according to the density measured by density sensor 16 (FIG. 1).

Step S(1)5

The printer controller 17 (FIG. 1) reads out |DB−SB| voltage from |DB−SB| voltage table according to image density No total drum count value Dp.

FIG. 4 shows |DB−SB| voltage table.

In FIG. 4, the image density No (%) of the above mentioned formula (f1) is assigned in the left end row. And, the total drum count value Dp is assigned in the upper end line. Therefore, the intersection of a line and a row on the table marks |DB−SB| voltage to be calculated.

The table shown in FIG. 4 should be compiled considering following points.

Point 1

In the line of the highest density of row (No=75 to 100), |DB−SB| voltage is set higher as the drum count value Dp becomes larger. The reason is as follows. Generally, it is necessary to increase the electric potential difference as the density of original image becomes higher, because more toner is consumed. However, toner conveying ability of toner conveying roller 9 (FIG. 2) decreases after repeated printing operation, because the radius of roller decreases by erosion of friction and the surface of roller loses its mesh by wearing away. Therefore, it is necessary to increase electric potential difference between toner conveying roller 9 (FIG. 2) and developing roller 7 (FIG. 2), so as to enhance conveying ability of toner electrically.

Point 2

In the line of the lowest density of original image (No=0 to 2.5), |DB−SB| voltage is set smaller as drum count value (Dp) becomes larger. The reason is that the white paper becomes dirty if the electric potential difference between DB and SB is set high when the image density is low. This is easily learned by experience. Therefore, it is necessary to decrease toner supply, so as to prevent the developing roller 7 (FIG. 2) from accumulating toner too much.

Step S(1)6

The printer controller 17 (FIG. 1) decides a stretching bias SB according to |DB−SB| voltage calculated by step S(1)5 and DB calculated by step S(1)4. In this occasion, usually there is a relationship of |DB|<|SB|. So, SB becomes a negative voltage of direct current when toner is charged negative. For example, SB becomes SB=−300V when DB=−200V and |DB−SB|=100V.

Incidentally, in the description mentioned above, as an example of |DB−SB| voltage table a table containing certain real numbers. However, these numbers are mere examples. So, the present invention is not limited to these examples as a matter of course. That is, values of |DB−SB| voltage are changed by necessity according to the kind of toner or type of image forming apparatus.

Moreover, in the description mentioned above, an automatic density correction is realized. That is, SB is decided directly from the value of dot counter 13 (FIG. 1). The reason is that the average image density of the whole A4 sheet is obtained from the total dot of the sheet detected by dot counter 13. And, the total toner consumption is calculated from this value. So, the real toner consumption is conceived to get from this total dot value.

However, there are other methods. An example is a method of correcting toner supply according to image density of image data on the sheet. The reason is that the toner consumption can be different according to whether the image data portion on the sheet is large or small, even if the average density of the whole sheet is same.

Another example is a method of correcting toner supply according to gradation level of image data together with the image density. This example can provide a further adequate SB voltage control, because further exact toner consumption can be predicted by this method.

Effect of Embodiment 1

As mentioned above, in the image forming apparatus according to Embodiment 1, a clear image on the sheet can be obtained without dim images or blurs owing to aging of apparatus, at every density of original image, because the voltage (SB) impressed to the toner conveying roller can be controlled according to the density of original image with predicting aging of toner conveying roller, which is caused by repetition of printing operation.

Embodiment 2

Embodiment 2 is what is added a correcting control of SB according to aging state of toner in the image forming apparatus, to the control of Embodiment 1. Therefore, its configuration is entirely same as Embodiment 1. And, only the control method is different. Hereafter, the control method is described referring to the flowchart.

FIG. 5 is the flowchart showing the control of Embodiment 2.

The operation of Embodiment 2 is described according to step S(2)1 to step S(2)15 in FIG. 5.

Step S(2)1

The image signal processor 12 (FIG. 1) accepts image data 18 (FIG. 1) of one page of A4 size sheet. And, it transforms the data into dot data. In this occasion, the dot counter 13 (FIG. 1) measures total dot number of original image. And, it obtains the count value Do. This Do is recorded in the data ROM 15 (FIG. 1). This step is same as the step S(1)1 of Embodiment 1.

Step S(2)2

The printer controller 17 (FIG. 1) reads out count value Df (which is contained in the data ROM 15 in advance) representing a prescribed dot number in the occasion of printing 100% Duty image of one page of A4 sheet. And, it reads out Do mentioned above from the data ROM 15 (FIG. 1). Then, it calculates image density No according to following formula.

$$No=(Do/Df)\times 100(\%) \quad (f1)$$

This step is same as step S(1)2 of Embodiment 1.

Step S(2)3

The printer controller 17 (FIG. 1) reads out total drum count value Dp, which is the accumulated count number of photo-sensitive drum 1 (FIG. 1) until now, from the date ROM 15 (FIG. 1). This step is same as step S(1)3 of Embodiment 1.

Step S(2)4

The printer controller 17 (FIG. 1) obtains, from the data ROM 15 (FIG. 1), drum count value Dt, which is the accumulated count number of photo-sensitive drum 1 (FIG. 1) from the last time when toner tank is replaced with a new one, until now.

Step S(2)5

If Dt is 500 revolutions, then the process proceeds to next step S(2)6. Otherwise, the process jumps to step S(2)10. The reason is that it is necessary to correct toner supply when the printer has printed less than 500 sheets, because the toner is not so old yet.

Step S(2)6

The printer controller 17 (FIG. 1) obtains total dot count Dt after the last time when the toner tank is replaced, from data ROM 15 (FIG. 1).

Step S(2)7

The printer controller 17 (FIG. 1) calculates the average printing density N1 from toner tank replacement until now, according to next formula.

$$N1=\{D1/(Df\times Dt)\}\times 100(\%) \quad (f2)$$

The average image density is calculated by this step.

Step S(2)8

The printer controller 17 (FIG. 1) refers to the average printing density correcting voltage table.

FIG. 6 shows this table.

In the left end row of FIG. 6, the image density No (%) by formula (f1) is written. And, in the upper end line of FIG. 6, the average printing density N1 (%) by formula (f2) is written. Therefore, the intersection of the N1 line of each No interval and the No row of each N1 interval, represents the correcting voltage Vn to be calculated.

This table is used for correcting |DB−SB| voltage. Toner in the tank is becoming older as printing after tank replacement has processed at lower duty (less N1 (%)). It is more necessary to correct |DB−SB| voltage when N1 is less than usual.

In the correcting voltage table by average printing density, it is necessary to consider following point.

Point

Generally, correcting voltage Vn becomes less as average printing density N1 (%) becomes higher. It becomes zero at the end. On the other hand, it becomes larger, because toner is getting older. And, in this occasion, |DB−SB| voltage is corrected less as the image density is less, because the sheet is likely to get blurred when toner is old. On the other hand, |DB−SB| voltage is corrected more as the image density is more, because the image on the sheet is likely to dim when toner is old.

Step S(2)9

The printer controller 17 (FIG. 1) obtains the correcting voltage Vn from the correcting voltage table by average printing density.

Step S(2)10

The printer controller 17 (FIG. 1) reads out developing bias voltage DB from the automatic density correcting table of the data ROM 15 (FIG. 1) according to the density measured by the density sensor 16 (FIG. 1). This step is same as the step S(1)4 of Embodiment 1.

Step S(2)11

The printer controller 17 (FIG. 1) reads out |DB−SB| voltage from |DB−SB| voltage table (FIG. 4) according to image density No and total drum count value Dp, which are already contained in the data ROM 15 (FIG. 1). This step is same as the step S(1)5 of Embodiment 1.

Step S(2)12

The printer controller 17 (FIG. 1) replaces |DB−SB| voltage obtained at step S(2)11, with |DB−SB|+Vn.

Step S(2)13

If |DB−SB| is more than or equal to 25V, then the process proceeds to step S(2)14. Otherwise that is if it is less than 25V, it is set to 25V and the process proceeds to step S(2)14 (step S(2)15).

Step S(2)14

The printer controller 17 (FIG. 1) decides a stretching bias SB from |DB−SB| voltage calculated by step S(2)13 and step S(2)15 and DB calculated by step S(2)10. In this occasion, usually there is a relationship of |DB|<|SB|. So, SB becomes a negative voltage of direct current when toner is charged negative.

As mentioned above, the whole control process of Embodiment 2 ends.

Effect of Embodiment 2

As described above, the image on a sheet obtained by Embodiment 2, becomes stabler than that of Embodiment 1, without blurs or dims, by correcting toner supply considering aging state of toner.

Embodiment 3

Embodiment 3 is what is added to Embodiment 1 or 2, an environmental control for the image forming apparatus.

Figure 7:
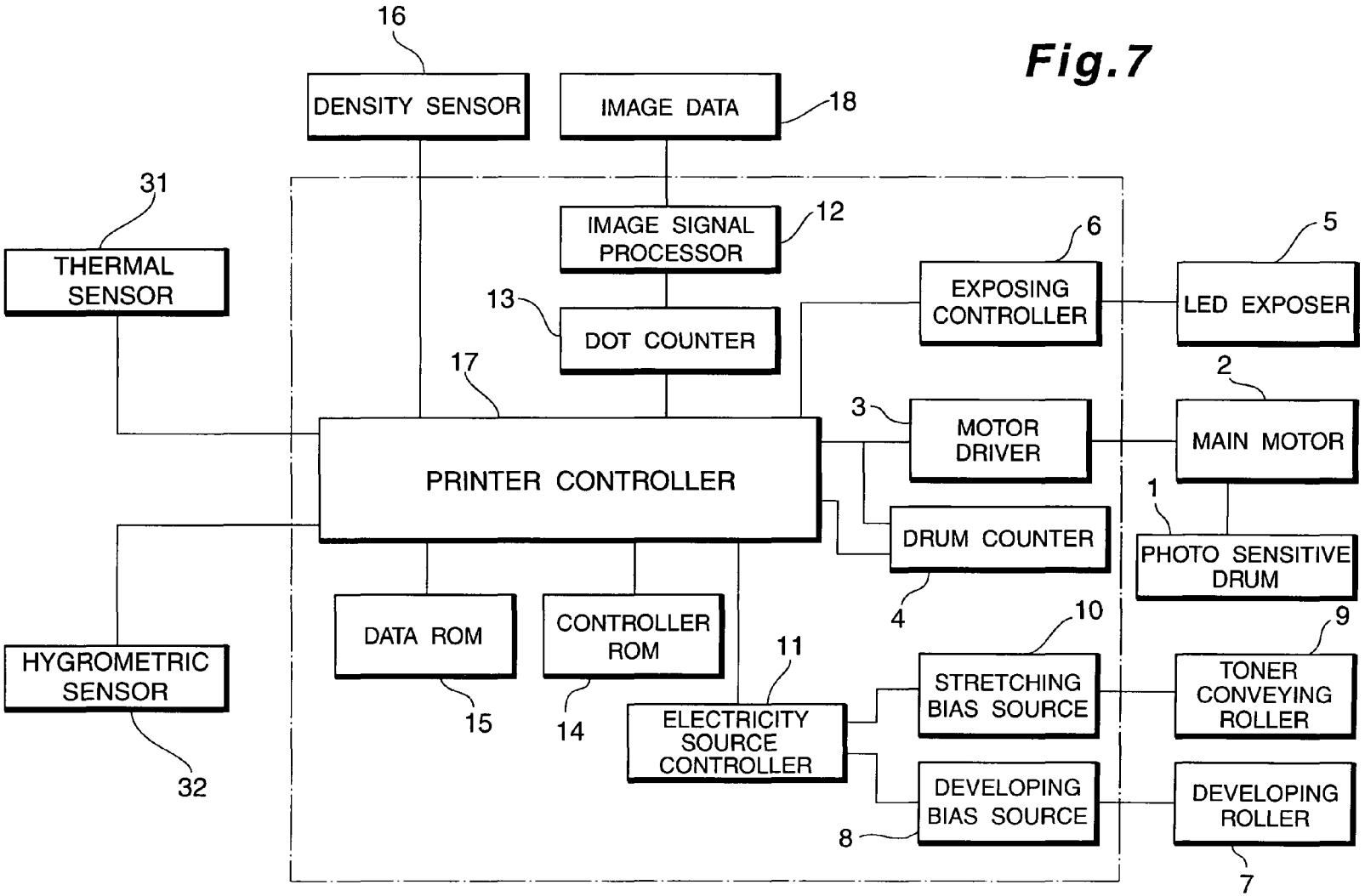
FIG. 7 is a block diagram showing the configuration of Embodiment 3.

FIG. 7 is a block diagram showing the configuration of Embodiment 3.

As shown in FIG. 7, the image forming apparatus of Embodiment 3 comprises a photo-sensitive drum 1, a main motor 2, a motor driver 3, a drum counter 4, an LED exposer 5, an exposing controller 6, a developing roller 7, a developing bias source 8, a toner conveying roller 9, a stretching bias source 10, an electricity source controller 11, an image signal processor 12, a dot counter 13, a controller ROM 14, a data ROM 15, a density sensor 16, a printer controller 17, a thermal sensor 31 and a humid sensor 32.

Now, only the difference with the configuration of Embodiment 1 is described.

The thermal sensor 31 is a sensor for measuring the temperature of atmosphere around the image forming apparatus.

The humid sensor 32 is a sensor for measuring the humidity of atmosphere around the image forming apparatus.

The other component sections are all same as Embodiment 1 or 2. So, the duplicated description is omitted.

Figures 8, 9:
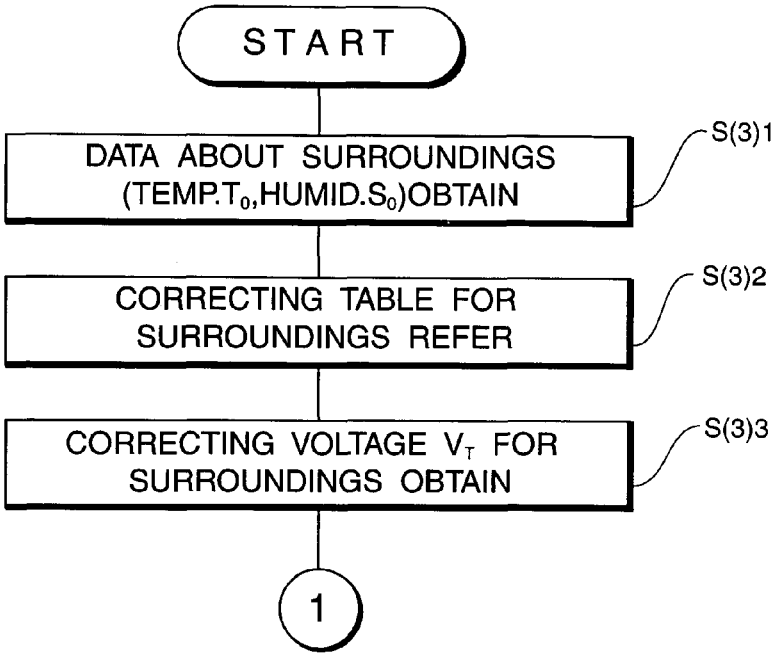
FIG. 8 is a flow-chart showing the control process of Embodiment 3.
FIG. 9 shows the environmental correcting voltage table of Embodiment 3.

FIG. 8 is a flowchart showing the control process of Embodiment 3.

The operation of Embodiment 3 is described according to step S(3)1 to step S(3)3 of FIG. 8.

Step S(3)1

The printer controller 17 (FIG. 7) obtains environmental data (temperature To, humidity So) from the thermal sensor 31 and humid sensor 32.

Step S(3)2

The printer controller 17 (FIG. 7) refers to the environmental correcting voltage table, which is contained in the controller ROM 14 in advance.

Figure 14:
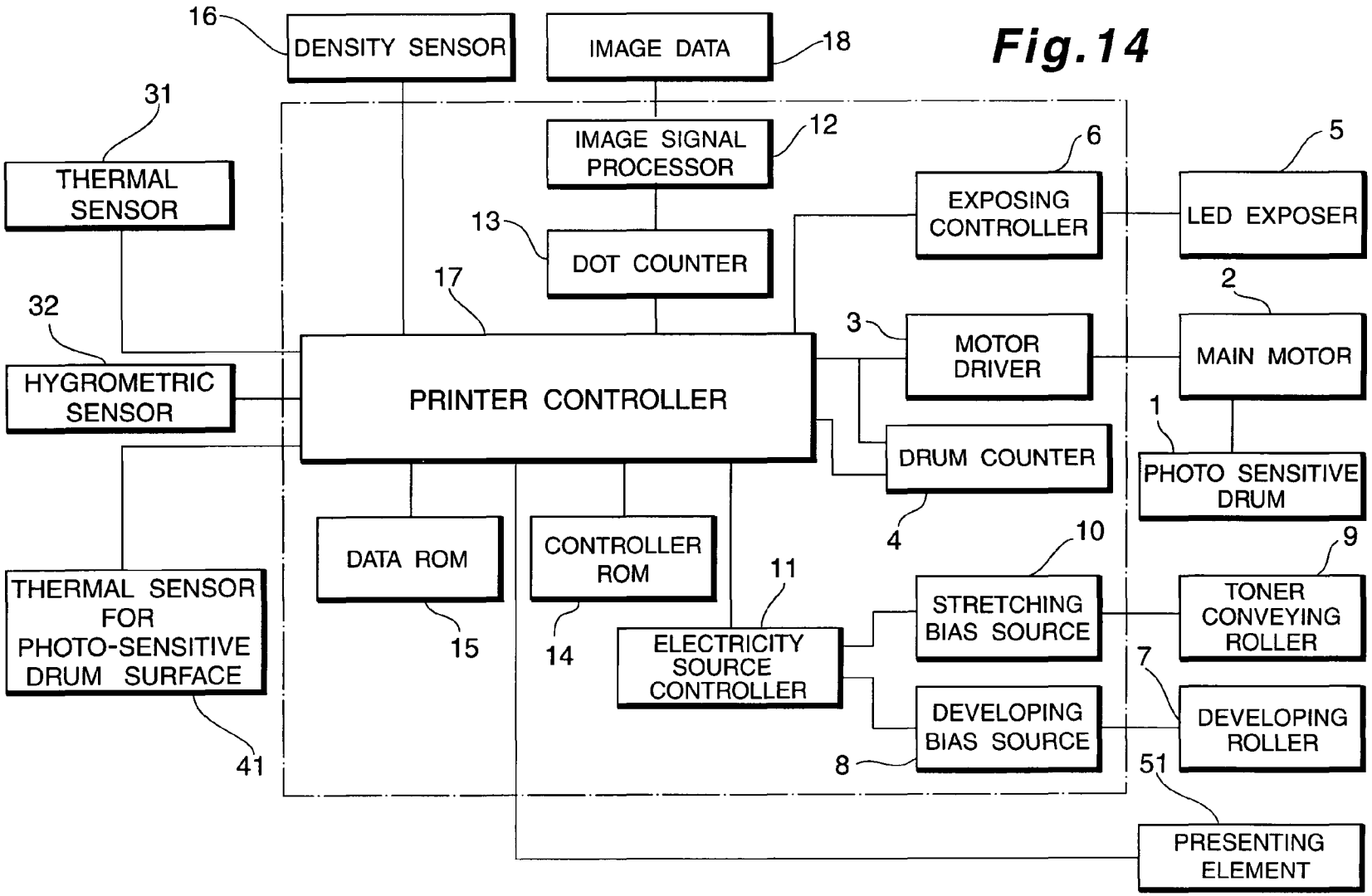
FIG. 14 is a block diagram showing the configuration of Embodiment 5.

FIG. 14 shows the environmental correcting voltage table.

The left end row in FIG. 9 shows the temperature (° C.) around apparatus. And, the upper end line in FIG. 9 shows the humidity (%) around apparatus. Therefore, the intersection of each line and row represents the correcting voltage Vt to be calculated.

This table is used for correcting |DB−SB| voltage according to the environmental condition of apparatus, because the leak of charge on the surface of toner becomes less and the charge load of toner increase more as temperature or humidity become lower. On the contrary, the leak of charge on toner surface increases and the charge load decreases as temperature or humidity increase. So, it is necessary to consider following point, to compile the environmental correcting voltage table.

Point

|DB−SB| voltage is corrected to decrease as either temperature or humidity decrease. On the contrary, |DB−SB| voltage is corrected to increase as either temperature or humidity increase. The reason is that to keep adequate toner supply high voltage is needed when toner charge is small and the voltage must be low when toner charge is large. So, each element in the table should be set as shown in FIG. 9.

Step S(3)3

The printer controller 17 (FIG. 7) obtains the correcting voltage Vt from the environmental correcting voltage table.

After these processes, for example, the processes shown in the flowchart of Embodiment 2 in FIG. 5 is continued. However, in this occasion, at step S(2)12, |DB−SB| is replaced with |DB−SB|+Vt. Or, instead, |DB−SB| is replaced with |DB−SB|+Vn+Vt, in the occasion when the voltage correction is processed by a combination of Embodiment 2 and Embodiment 3.

Effect of Embodiment 3

As described above, according to Embodiment 3, as well as the effect of Embodiment 1 or 2, still stabler image on a sheet without blurs or dims, can be obtained, even if the environmental condition should change; because the voltage correcting control according to temperature To and humidity So, is added to the control of Embodiment 1 or Embodiment 2.

Embodiment 4

Embodiment 4 is what is added to the control of Embodiment 3, with another correcting control, which is processed according to surface temperature state of the photo-sensitive drum of image forming apparatus.

Figure 10:
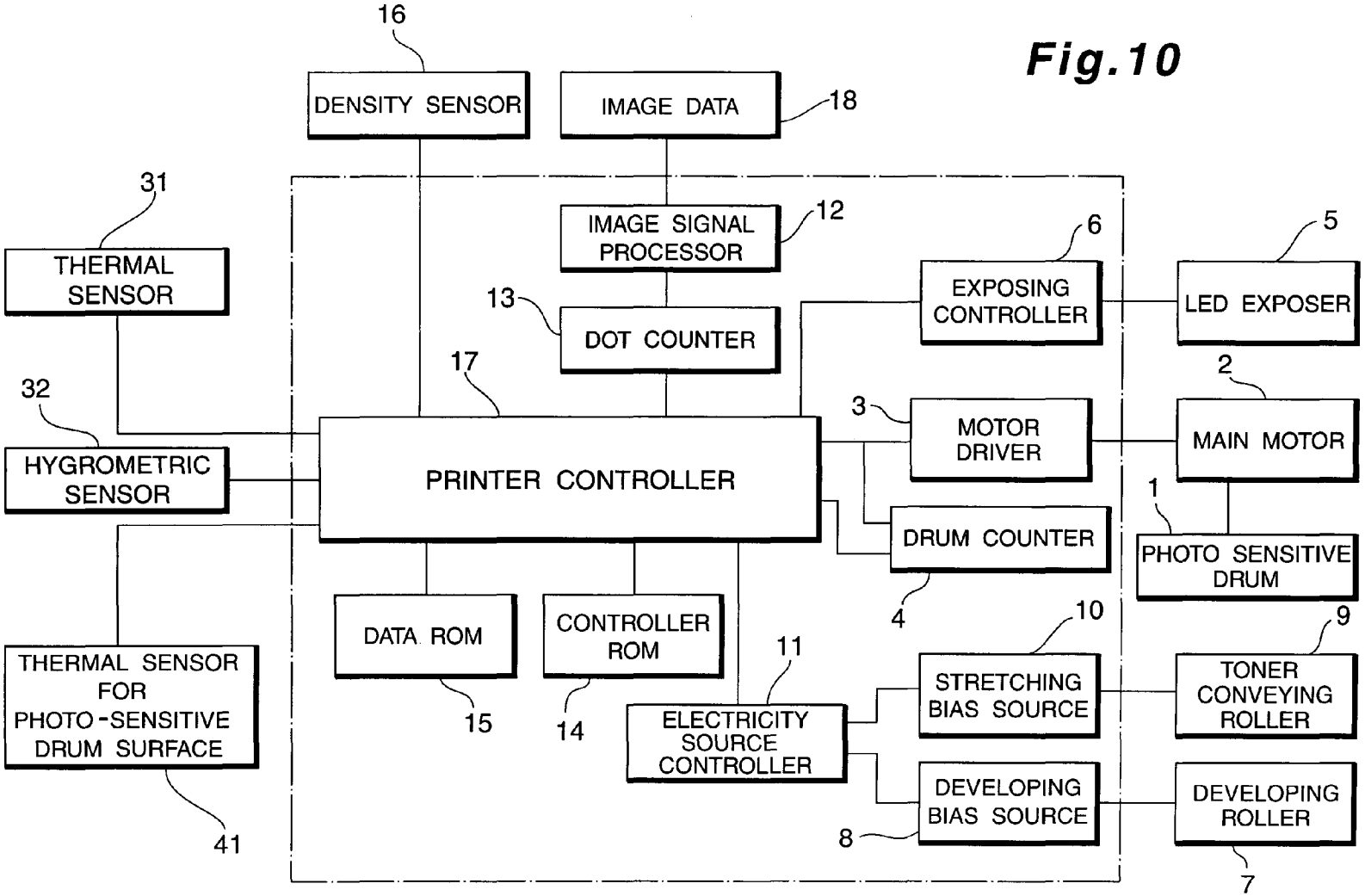
FIG. 10 is a block diagram showing the configuration of Embodiment 4.

FIG. 10 is a block diagram showing the configuration of Embodiment 4.

As shown in FIG. 10, the image forming apparatus of Embodiment 4 comprises a photo-sensitive drum 1, a main motor 2, a motor driver 3, a drum counter 4, an LED exposer 5, an exposing controller 6, a developing roller 7, a developing bias source 8, a toner conveying roller 9, a stretching bias source 10, an electricity source controller 11, an image signal processor 12, a dot counter 13, a controller ROM 14, a data ROM 15, a density sensor 16, a printer controller 17, a thermal sensor 31, a humid sensor 32, and a photo-sensitive drum surface thermal sensor 41.

Now, only the difference with the configuration of Embodiment 4 is described.

The photo-sensitive drum surface thermal sensor 41 is a sensor for measuring the temperature on the surface of photo-sensitive drum in operation.

The other component sections are entirely same as Embodiment 3. So, the same description is omitted.

Figure 11:
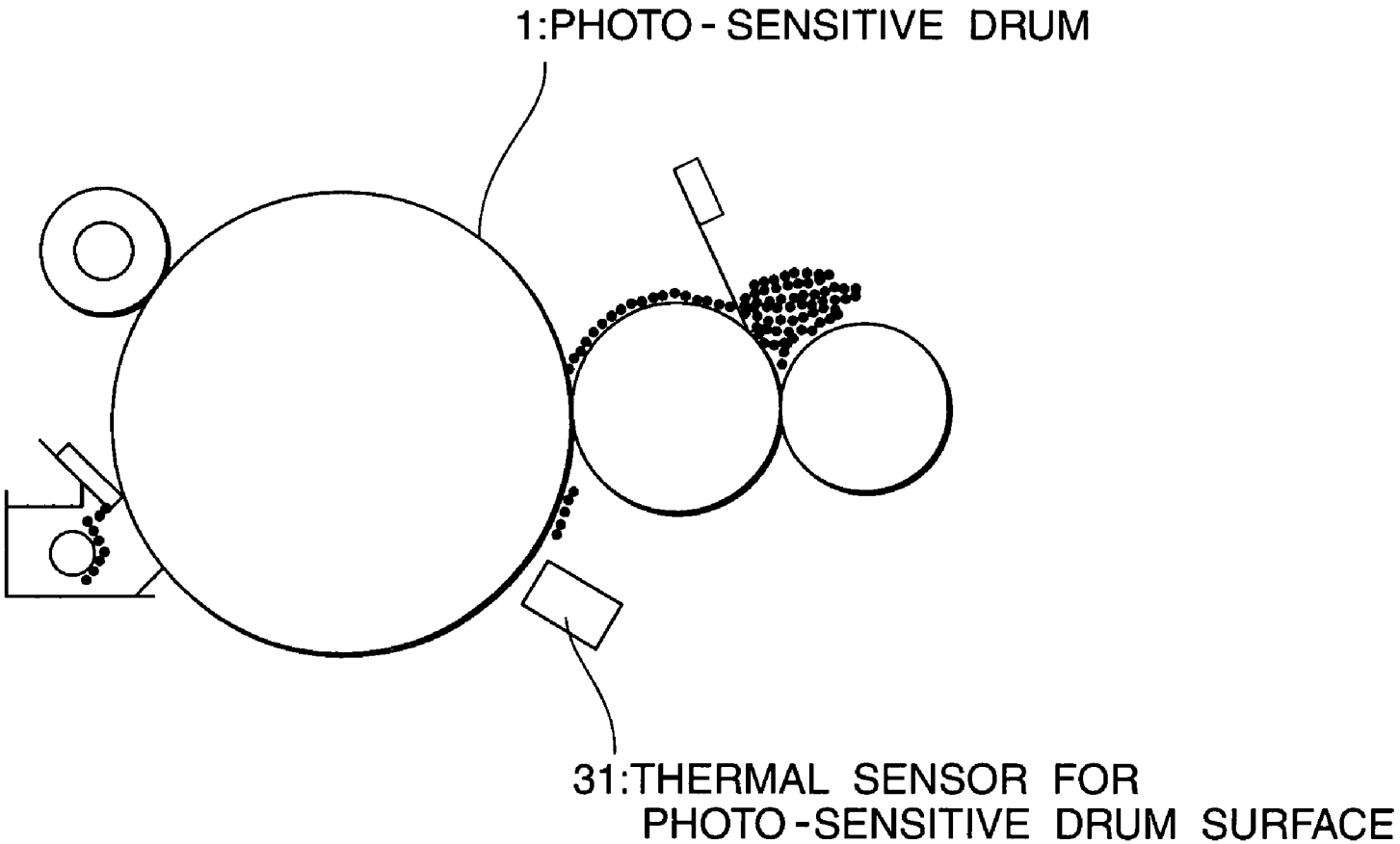
FIG. 11 is a sectional view of the configuration of Embodiment 4.

FIG. 11 is a sectional view of the configuration of Embodiment 4.

As shown in FIG. 11, the photo-sensitive drum surface thermal sensor 41 is provided in the vicinity of the photo-sensitive drum 1.

Figures 12, 13:
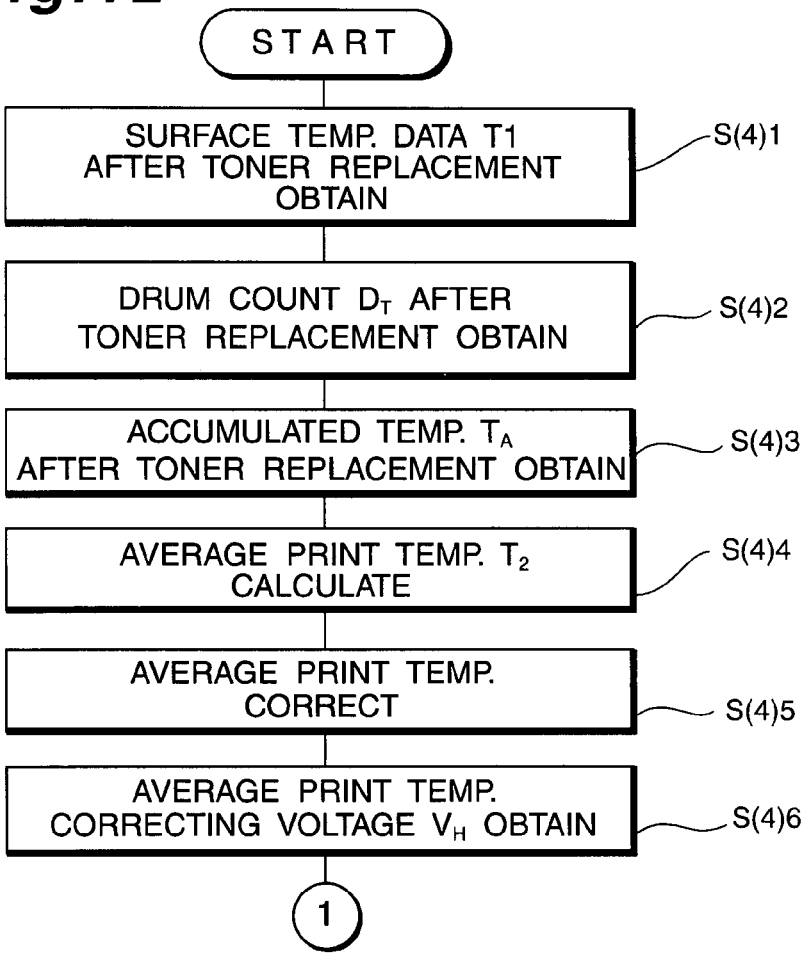
FIG. 12 is a flow-chart showing the control process of Embodiment 4.
FIG. 13 shows the average printing temperature correcting voltage table of Embodiment 4.

FIG. 12 is a flow-chart showing the control of Embodiment 4.

The operation of Embodiment 4 is described according to step S(4) 1 to step S(4)6 in FIG. 12.

Step S(4)1

The printer controller 17 (FIG. 10) obtains temperature data T1, which have ever been measured by the photo-sensitive drum surface thermal sensor 41 (FIG. 10), from the last time when toner tank was replaced until now. In this occasion, the detection of sensor is processed at each count detected by drum counter 4 (FIG. 10) when the photo-sensitive drum 1 rotates one revolution. Then, these temperature data T1 are memorized accumulating in the data ROM 15 (FIG. 10).

Step S(4)2

The printer controller 17 (FIG. 10) obtains count number Dt of drum counter 4 (FIG. 10) measured from toner tank replacement until now, from the data ROM 15 (FIG. 10).

Step S(4)3

The printer controller 17 (FIG. 10) obtains the accumulated temperature data Ta revised from toner tank replacement until now, from the data ROM 15 (FIG. 10).

Step S(4)4

The printer controller 17 (FIG. 10) calculates an average printing temperature T2 from Dt and Ta mentioned above, according to following formula.

$$T2=(Ta/Dt) \quad (f3)$$

Step S(4)5

The printer controller 17 (FIG. 10) refers to the average printing temperature correcting voltage table, which is contained in the controller ROM 14 in advance.

FIG. 13 shows the average printing temperature correcting voltage table.

The left end row in FIG. 13 shows the average printing temperature T2 (° C.). And, the upper end line in FIG. 13 shows the drum count Dt. Therefore, the intersection of each line and row, indicated at the left end row T2 and upper end line Dt, represents the correcting voltage Vh to be calculated.

This average printing temperature correcting voltage table is used for correcting |DB−SB| voltage, by pre-estimating that toner deteriorates early when printing temperature is high. And, the deterioration of toner proceeds as the drum count increases. So, it is necessary to consider following point, to compile this table.

Point to Consider

|DB−SB| voltage is set higher as drum count increases at higher temperature, pre-estimating the early deterioration of toner.

Step S(4)6

The printer controller 17 (FIG. 10) obtains the correcting voltage Vh from the average printing temperature correcting voltage table.

After these processes, for example, the processes shown in the flowchart of Embodiment 2. However, in this occasion, at step S(2)12, |DB−SB| is replaced with |DB−SB|+Vh. Or, istead, |DB−SB| is replaced with |DB−SB|+Vn+Vh in the occasion when the voltage correction is processed by a combination of Embodiment 2 and Embodiment 4. Or, further instead, |DB−SB| is replaced with |DB−SB|+Vn+Vt+Vh in the occasion when the voltage correction is processed by a combination of Embodiment 2, 3 and 4.

Effect of Embodiment 4

As mentioned above, according to Embodiment 4, as well as the effect of Embodiment 1, 2 or 3, even stabler image on a sheet without blurs or dims, can be obtained; by adding to the control of Embodiment 1, 2 or 3, with another voltage correction, which is processed by measuring the surface temperature of photo-sensitive drum, calculating average printing temperature from the measured temperature records and drum count, and pre-estimating the aging rate of toner.

Embodiment 5

In Embodiment 5, a presenting device, which gives the user various kinds of information, is provided to Embodiment 1, 2, 3 or 4.

FIG. 14 is a block diagram showing the configuration of Embodiment 5.

As shown in FIG. 14, the image forming apparatus of Embodiment 5 comprises a photo-sensitive drum 1, a main motor 2, a motor driver 3, a drum counter 4, an LED exposer 5, an exposing controller 6, a developing roller 7, a developing bias source 8, a toner conveying roller 9, a stretching bias source 10, an electricity source controller 11, an image signal processor 12, a dot counter 13, a controller ROM 14, a data ROM 15, a density sensor 16, a printer controller 17, a thermal sensor 31, a humid sensor 32, a photo-sensitive drum surface thermal sensor 41, and a presenting element 51.

Here, only the difference with Embodiment 4, is described.

The presenting element 51 is a presenting device for informing the user of various kinds of information. This usually comprises a liquid crystal display.

All of the other component sections are entirely same as Embodiment 4. So, the same description is omitted.

Figure 15A:
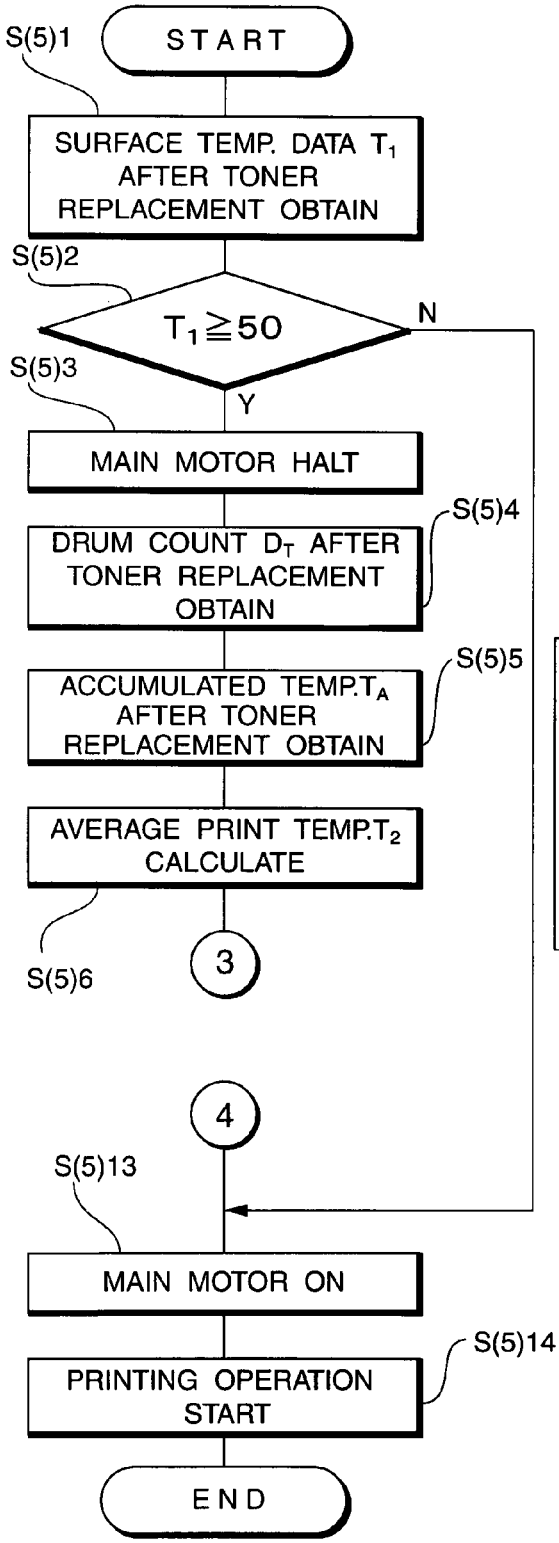
FIG. 15 is a flow-chart showing the control process of Embodiment 5.
Figure 15B:
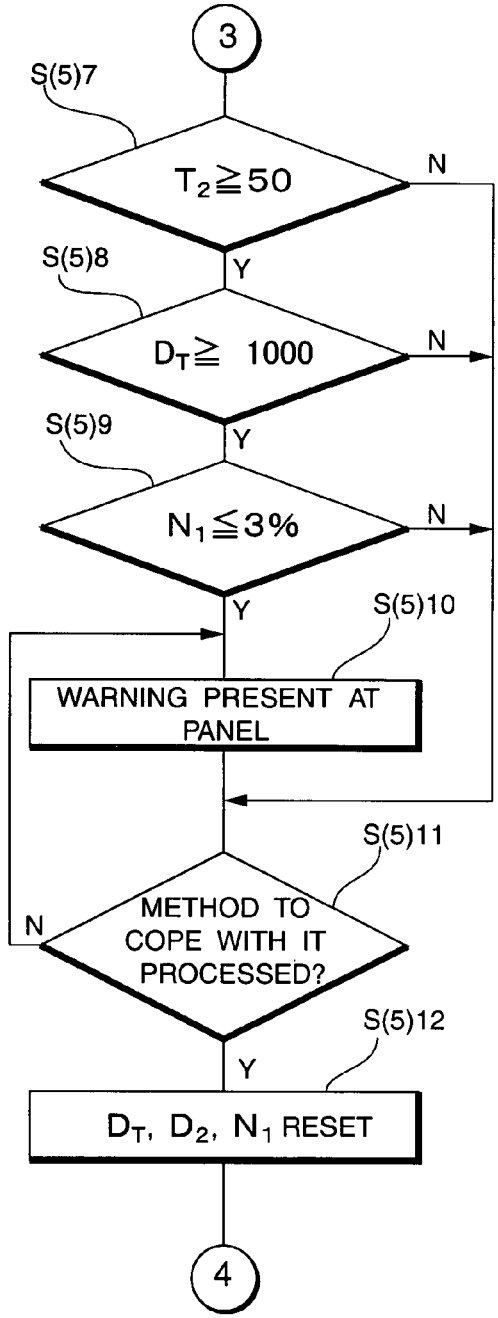

FIG. 15 is a flowchart according to Embodiment 5.

The operation of Embodiment 5 is described according to step S(5)1 to step S(5)14.

Step S(5)1

The printer controller 17 (FIG. 14) obtains a temperature data T1 from the photo-sensitive drum surface thermal sensor 41 (FIG. 14). Here, detecting a signal of the sensor is processed at each one count (one revolution of the photo-sensitive drum) of the drum counter 4 (FIG. 14). This temperature data T1 is memorized in the data ROM 15 (FIG. 14), accumulating there.

Step S(5)2

The printer controller 17 (FIG. 14) turns the main motor 2 (FIG. 14) on (step S(5)13), if the temperature data T1 obtained from the photo-sensitive drum surface thermal sensor 41 (FIG. 14) is less than 50° C.; so as to let printer begin printing (step S(5)14). Otherwise that is if T1 is more than or equal to 50° C., the process proceeds to step S(5)3.

Step S(5)3

The printer controller 17 (FIG. 14) stops the main motor 2 (FIG. 14), so as to prevent toner from getting deteriorated in very short time.

Step S(5)4

The printer controller 17 (FIG. 14) obtains count number Dt of the drum counter 4 (FIG. 14) from the data ROM 15 (FIG. 14), in the term between the last time of toner tank replacement and now.

Step S(5)5

The printer controller 17 (FIG. 14) obtains the accumulated temperature data Ta from the data ROM 15 (FIG. 14), in the term between the last time of toner tank replacement and now.

Step S(5)6

Printer controller 17 (FIG. 14) calculates the average printing temperature T2 from the above Dt and Ta according to following formula.

$$T2=(Ta/Dt) \quad (f3)$$

Step S(5)7

When the average printing temperature T2 is less than 50° C., the process jumps to step S(5)11. When it is more than or equal to 50° C., the process proceeds to the next step.

Step S(5)8

When the drum count Dt is less than 1000, the process jumps to step S(5)11. When it is more than or equal to 1000, the process proceeds to the next step.

Step S(5)9

When the average printing density N1 is more than or equal to 3%, the process jumps to step S(5)11. When it is less than 3%, the process proceeds to the next step.

Step S(5)10

The printer controller 17 (FIG. 14) performs a presentation of attention at the presenting element 51.

Step S(5)11

The printer controller 17 (FIG. 14) puts off printing until the user allows according to the procedure written in the operation manual. On the other hand, when the user allows printing according to the procedure, the process proceeds to the next step. Here, as the procedure to stop presentation of attention, for example, there is a method of taking out a certain portion of the image forming apparatus for a while, and shaking it sufficiently, so as to stir up the toner in the toner tank.

Step S(5)12

The printer controller 17 (FIG. 14) resets T2, Dt, N1. After this step, the process proceeds to the step S(5)13, to begin operation of printing.

As mentioned above, according to Embodiment 5, the image forming apparatus is characterized by presenting attention at presenting element when a certain condition about toner deterioration, average printing temperature, drum count and average printing condition, is satisfied; and obliging the printer to stop until the user allows with a certain method.

Effect of Embodiment 5

As mentioned above, according to Embodiment 5, toner deterioration by high temperature and low density, can be prevented, because the printer is obliged to stop operating as far as a certain method is not performed while an attention is presented at a presenting element informing the user that the average printing temperature, the average printing density and drum count value have reached to a certain value.

Moreover, excluding high temperature low density printing, only in a good condition, the electric potential difference between the developing voltage and the toner supplying voltage can be adjusted according to the image density to print. So, a preferable image without dims or blurs can be formed whatever is the image density, because any image is not printed at low density of high temperature.

What is claimed is:

1. An image developing apparatus comprising:

a first electricity source;

a second electricity source;

an image density detecting means for detecting image density from image data for an image being developed at the present time;

a controller for controlling each of said first electricity source and said second electricity source so that a difference between a first voltage provided by said first electricity source and a second voltage provided by said second electricity source becomes larger as said image density detected by said image density detecting means increases and becomes smaller as said image density detected by said image density detecting means decreases;

a developing means impressed with said first voltage provided by said first electricity source; and a developing material supplying means impressed with said second voltage provided by said second electricity source, supplying developing material to said developing means, wherein said controller, after controlling each of said first electricity source and said second electricity source according to said image density, causes said developing material to be transferred onto an image holder, so as to form said image being developed.

2. An image developing apparatus according to claim 1, wherein said controller controls electric potential difference between said first voltage and said second voltage according to said image density detected by said image density detecting means.

3. An image developing apparatus according to claim 1 further comprising:

a limiting means for toner, which limits a thickness of toner layer formed on the surface of developing means, wherein said first electricity source impresses said limiting means for toner, with said first voltage.

4. An image developing apparatus according to claim 1 further comprising:

an operation amount detecting means of detecting an amount of operation, wherein said controller controls each of said first electricity source and said second electricity source according to said amount of operation and said image density.

5. An image developing apparatus according to claim 4, wherein said operation amount detecting means detects said amount of operation according to a measured number of revolutions of said image holder.

6. An image developing apparatus according to claim 4, wherein said controller decreases electric potential difference between said first electricity source and said second electricity source as said amount of operation increases in the case when said image density is near 0%.

7. An image developing apparatus according to claim 4, wherein said controller increases electric potential difference between said first electricity source and said second electricity source as said amount of operation increases in the case when said image density is near 100%.

8. An image developing apparatus according to claim 1 wherein said controller calculates an average image density between the last time of toner tank replacement and the present time, from records stored in a memory of image density detected by said image density detecting means, so as to control each of said electricity sources according to said average image density.

9. An image developing apparatus according to claim 8 wherein said controller controls the difference between the first voltage and the second voltage to increase more in the case of low average image density than in the case of high average image density.

10. An image developing apparatus according to claim 1 further comprising an environmental condition detecting means of detecting environmental conditions surrounding the apparatus in operation, wherein said controller corrects each of said first and second electricity sources according to said environmental conditions.

11. An image developing apparatus according to claim 10 wherein said controller controls the difference between the first voltage and the second voltage to increase more in the case of high temperature and high humidity than in the case of low temperature and low humidity of said environmental conditions.

12. An image developing apparatus according to claim 1 further comprising:

a surface temperature detecting means for detecting surface temperature of said image holder, wherein said controller calculates average printing temperature from records stored in a memory of surface temperature detected by said surface temperature detecting means; so as to correct each of said electricity sources according to said average printing temperature.

13. An image developing apparatus according to claim 12 wherein said controller controls the difference between the first voltage and the second voltage to increase more in the case of high temperature than in the case of low temperature of average surface temperature of said image holder.

14. An image developing apparatus according to claim 12 further comprising:

a presenting means for presenting a prescribed message, wherein said controller informs a user of said image developing apparatus by presenting said prescribed message at said presenting means when said average printing temperature exceeds a prescribed temperature.

15. An image developing apparatus comprising:

a developing means for putting developing material to be transferred onto an image holder, so as to form an image corresponding to image data;

a developing material supplying means for supplying said developing material to said developing means;

a first electricity source for impressing said developing means with a first voltage;

a second electricity source for impressing said developing material supplying means with a second voltage having a same polarity as said first voltage and having a larger magnitude than said first voltage;

a first memory to store a first setting value being set according to an image density setting condition;

a second memory to store a plurality of values of difference between said first voltage and said second voltage corresponding to a plurality of different apparatus states; and a controller for controlling said first electricity source according to said first setting value and controlling said second electricity source according to the sum of the one of said plurality of difference values corresponding to the present apparatus state, read out from said second memory, and said first setting value read out from said first memory.

16. An image developing apparatus comprising:

a developing means for putting developing material to be transferred onto an image holder, so as to form an image corresponding to image data, a developing material supplying means for supplying said developing material to said developing means;

a first electricity source for impressing said developing means with a first voltage;

a second electricity source for impressing said developing material supplying means with a second voltage;

an operation amount detecting means for detecting an amount of operation with respect to images previously developed; and a controller for controlling the electric potential difference between said first electricity source and said second electricity source according to said amount of operation.

17. An image developing apparatus according to claim 16, wherein said operation amount detecting means detects said amount of operation according to a measured number of revolutions of said image holder.

18. An image developing apparatus according to claim 16 wherein said operation amount detecting means detects said amount of operation between the last time of toner tank replacement and the present time.

19. An image forming apparatus comprising:

a first electricity source;

a second electricity source;

an image density detecting means for detecting image density from image data for an image being formed at the present time;

a controller for controlling each of said first electricity source and said second electricity source so that a difference between a first voltage provided by said first electricity source and a second voltage provided by said second electricity source becomes larger as said image density detected by said image density detecting means increases and becomes smaller as said image density detected by said image density detecting means decreases;

a developing means impressed with said first voltage provided by said first electricity source;

a developing material supplying means impressed with said second voltage provided by said second electricity source, supplying developing material to said developing means; and an image forming means including an image holder for forming an electro-static latent image, to which said developing material is transferred by said developing means, wherein said controller, after controlling each of said first electricity source and said second electricity source according to said image density, causes said developing material to be transferred onto said image holder, so as to develop said image being formed.

20. An image forming apparatus according to claim 19, further comprising:

a charging means for charging said image holder; and an exposing means for exposing said image holder to light based on the image data to form said electro-static latent image.

* * * * *